United States Patent [19]

Metwaly

[11] Patent Number: 4,670,842

[45] Date of Patent: Jun. 2, 1987

[54] METHOD AND SYSTEM FOR THE GENERATION OF ARABIC SCRIPT

[75] Inventor: Mohamed F. Metwaly, Markham, Canada

[73] Assignee: International Business Machines Corporation, Armonk, N.Y.

[21] Appl. No.: 609,036

[22] Filed: May 10, 1984

[30] Foreign Application Priority Data

May 17, 1983 [CA] Canada ..... 428313

[51] Int. Cl.[4] ..... G09G 9/30

[52] U.S. Cl. ..... 364/419; 400/111

[58] Field of Search ..... 364/419; 400/111, 63, 400/83; 178/30

[56] References Cited

U.S. PATENT DOCUMENTS 4,176,974 12/1979 Bishal et al. ..... 400/111
4,286,329 8/1981 Goertzel et al. ..... 400/111
4,298,773 11/1981 Diab ..... 178/30
4,374,625 2/1983 Hanft et al. ..... 400/83
4,400,697 8/1983 Currie et al. ..... 400/111
4,507,734 3/1985 Kaldas ..... 364/419
4,527,919 7/1985 Aown ..... 400/111

*Primary Examiner*—Charles E. Atkinson
*Assistant Examiner*—Kimthanh T. Bui
*Attorney, Agent, or Firm*—Laurence R. Letson

[57] ABSTRACT

For effecting the automatic selection of Arabic character forms for display/printing of Arabic script, the structure of Arabic words is defined in terms of the respective shapes of the characters, and then production rules are derived to logically effect selection of an appropriate variant shape for any given character. By the disclosed teaching, a method and system are defined capable of handling not only the usual text, but also initials, acronyms, vowels, compound shapes, special end-of-word and stand-alone shapes.

9 Claims, 17 Drawing Figures

METHOD AND SYSTEM FOR THE GENERATION OF ARABIC SCRIPT

This invention relates to a character generation method and system for use in word/text processing, displays, work stations and microcomputers, etc., that support those languages employing Arabic script.

BACKGROUND OF THE INVENTION

As is well known, Arabic script is cursive and is used in several languages, namely Arabic, Farsi and Urdu.

It is a context-sensitive script, the form or shape of characters varying in many cases in dependence upon the surrounding characters in any given line of text.

From the context sensitivity of Arabic script, and the fact that it contains many character-form variants, it is readily appreciated that the displaying or printing of such cursive script raises a significant problem in the correct selection of character forms.

Where input is effected by keyboard, the latter must either be designed to provide a key for each and every character form, or must be equipped with multi-function keys.

Any keyboard having separate keys for each form would be unduly cumbersome, while multi-function keys obviously result in a reduction of the rate at which even a skilled operator can produce text. These obvious expedients also lay the onus of proper form selection on the operator.

A better approach is to provide a more or less standard type of keyboard wherein the keys are marked for the basic or stand-alone form of characters, and employ logic to automatically select the appropriate form that each successive character must take.

To date, several efforts have been made to automate selection and, in the main, all appear to have focused on a concept that is well illustrated in U.S. Pat. No. 4,176,974, which issued on Dec. 4, 1979, to W. B. Bishai and J. H. McCloskey and is entitled "Interactive Video Display and Editing of Text in Arabic Script".

The concept noted above is based on the fact that various Arabic characters have respectively different modes of interconnection. Some character forms connect with other characters from both left and right, some may connect only to the right and some are of a stand-alone type connecting neither to the right nor to the left.

In accordance with Bishai et al, (Column 4 Lines 54 to 59), characters that are capable of connection at both sides respectively occur in four different forms:

1. independent or stand-alone (joined neither to right nor left)
2. final or end of word (joined rightwards only)
3. initial or first character in a word (joined leftwards only) (Arabic is written from right to left)
4. medial, or a character between Final and Initial (joined both leftwards and rightwards)

Thus, in the prior art, the forms or shapes that each character can adopt are classified in accorcance with their respective connection-states.

With reference to Bishai et al (supra), the latter, in dealing with multi-form characters within a multi-character word, initially displays each character in its "final" form. This, of course, necessitates a check of at least the preceding character, and, in the majority of cases, a re-shaping of each such character.

More specifically, Bishai et al checks the first preceding character to determine whether to display in Stand-alone or Final form. If Final form is correct, then the second preceding character must be checked to see whether the first preceding character should actually be displayed in the Initial or Medial form.

Further examples of systems or concepts similar to Bishai et al are found in U.S. Pat. Nos. 4,145,570 and 4 298,773, (K. M. Diab), and also in French Patent No. 4,490,365 (G. Kaldes).

A still further example of the above prior art concept is Canadian Pat. No. 1,044,806, issued Dec. 19, 1978, to Syed S. Hyder. The Hyder system is similar to Bishai et al with the exception that Hyder does not immediately display a selected character. Display occurs with the keying of the next character. This is deemed to be potentially confusing for an operator since, at any given time, the operator will key one character and see a different character displayed.

In summary, currently available concepts for the character generation of Arabic script suffer from the following drawbacks:

1. Delayed response when a succeeding character is unknown;
2. Multiple checking of preceding characters;
3. Re-shaping of each displayed character upon determining the succeeding character;
4. Inability to produce initials or acronyms;
5. Inability to support vowels when the latter are supported as separate characters; and
6. Inability to handle character forms that are necessarily displayable only in two adjacent dot matrices.

BRIEF DESCRIPTION OF THE INVENTION

The present invention is predicated on a new concept that calls for segregation of the characters into sets and sub-groups arranged respectively in accordance with the position a character can occupy in a word, and the respective number of variant shapes each character may have.

This new concept affords improvement, in particular, with the selection of specific forms for characters having multiple variants.

As a result of such segregation, any variant form in a group can be readily selected by virtue of the fact that only one form is appropriate for any given character position in a word.

These character positions are defined in an apparently similar, but significantly different, manner than the classifications of the prior art, as will be seen below.

For example, if one keys a character following a space, the present invention treats it as a "Beginning multi-character part" and selects the appropriate form. The next character to be keyed will then be treated as a "Middle multi-character part", and that appropriate form will be selected until the detection of a succeeding space reveals that the previous character was actually the last character of the multi-character word. Only for such last character would any re-shaping be necessary.

One other occasion for re-shaping occurs when a Beginning form is followed by a space, in which case, the form displayed would be re-shaped to Stand-alone form.

In all, re-shaping is drastically reduced and undue checking is eliminated.

It is thus a primary object of the present invention to provide a method and system for automatically generating Arabic script, for display, in such a manner as to reduce the incidence of re-shaping character forms, to eliminate delay in the displaying of a keyed character, and to greatly minimize the checking of preceding characters.

A further object of the present invention is to provide a method and system for automatically generating Arabic script that will permit the production of initials and acronyms, handle compound characters and shapes that occupy two dot matrices, as well as vowels.

It should be noted that the reduction or elimination of the checking of preceding characters is of significant importance for word or text processing applications. Word or text storage buffers can be complex and may be accessed only through text storage managers. Thus, each back-check involves a considerable amount of processing.

The present invention will be more readily understood from the following detailed description taken in conjunction with the appended drawings, wherein:

FIGS. 4-1 to 4-10 are a series of flow charts illustrating the logic employed in the realization of the invention;

FIG. 5 illustrates a suitable keyboard layout;

FIG. 6 illustrates two examples of the syntax of Arabic words as per the invention;

FIG. 7 is a diagrammatic representation of the general logic employed in the present invention;

FIG. 8 illustrates the structure of an Arabic word as treated by the present invention.

Figure 1:
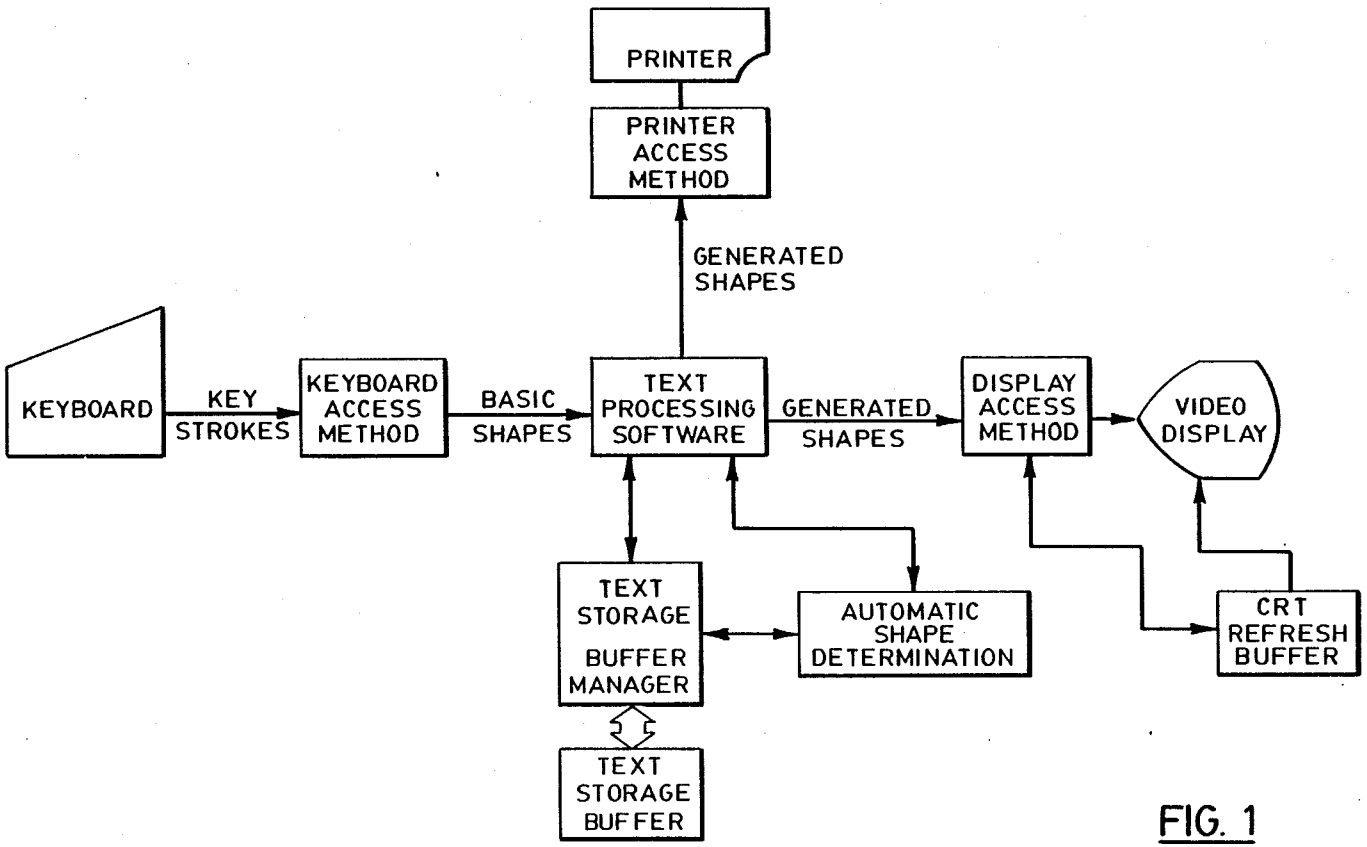
FIG. 1 is a block schematic of a text processing device embodying the invention.

Also introduced at this point are the following appendices:

Appendix A illustrates an Arabic character set supportable by the varioius machines in which the invention may be applied;

Appendix B-1 to B-5 illustrate examples showing keyed input and the step by step resultant output stemming from the use of the present invention;

Appendix C illustrates Arabic shapes or forms as grouped in accordance with the invention;

Appendix D provides a detailed classification of the character set of Appendix A.

DESCRIPTION OF A PREFERRED EMBODIMENT

The rules by or through which the present invention is implemented can be accepted by a Finite-State Machine, i.e., a concept in the Finite Automata Theory. The Finite-State Machine is a "machine" that has a number of states. It accepts an input and depending upon both such input and the machine's own state, switches to the proper state and produces the proper output. This machine can be implemented by either software or hardware.

For the purposes of this description, the software implementation will be employed.

For the solution of the problems in the automatic selection of Arabic character shapes according to the present invention, the idea is mainly to first define the structure of Arabic words in terms of the respective shapes of Arabic characters, and then to derive production rules for the words also in terms of the shapes.

Since Arabic is a cursive script, it is appreciated that the shapes of the characters of any Arabic word must necessarily interconnect one with another. Essentially then, an Arabic word is constructed by a number of disjoint parts.

For purposes of clarity, the following definitions are given:

1. A Character

A character of the alphabet supported on the keyboard.

2. Shape (Of A Character)

This is the shape or form with which a character may be represented in a word. A shape depends upon the position of the character in the word, and a character may be represented by any one of up to four variant shapes. For some characters, a single shape, respectively, may be used to represent its character in more than one position in a word.

3. Arabic Word

For the purpose of this description, an Arabic word may be defined as any group of Arabic characters between any two delimiters. A word may consist of one or more parts. A part of a word is one or more characters connected to each other in accordance with the rules of Arabic script.

4. Character Positions In A Word

A character may appear in any one of the following positions within a word. The letter 'P' is used to denote 'position'

$P_B$—Beginning of a multi-character part.

$P_M$—Middle of a multi-character part.

$P_{EW}$—End of the last multi-character part.

$P_F$—The last one-character part (free standing)

$P_P$—A one-character part (other than the last part)

$P_{EP}$—End of a multi-character part (other than the last part)

5. Dividing Character

A character that can only be written at the end of "parts", i.e., doesn't join to a succeeding character.

6. Non-Dividing Character

A character that cannot be written at the end of "parts", i.e., does connect to succeeding characters.

In accordance with the above definition of "Arabic word", the functional classes of characters may be defined as follows:

$S_{ND}$—Set of non-dividing characters $S_D$—Set of dividing characters $S_V$—Set of vowels (Vowels are considered here as characters, per se, and each has two shapes)

Figures 1, 4:
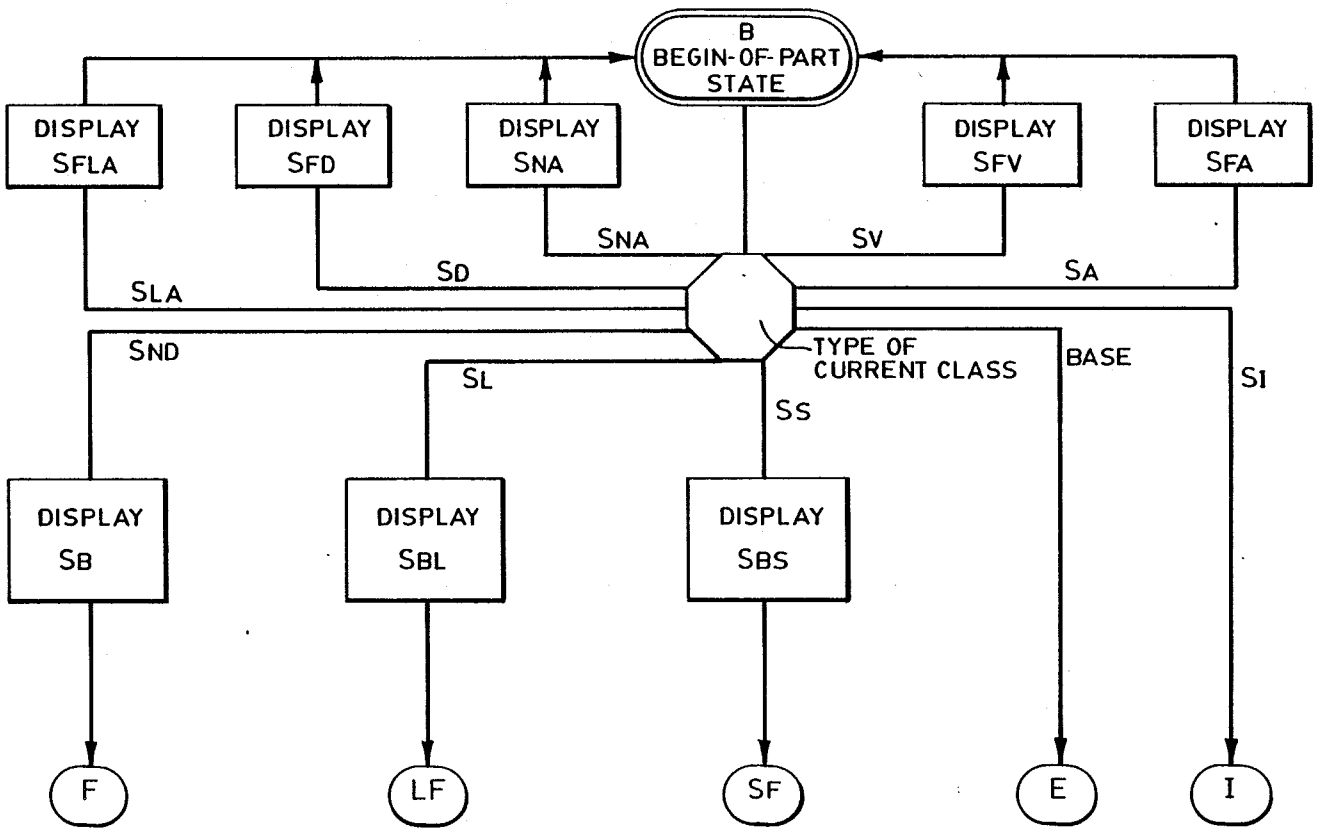
Figures 2, 4:
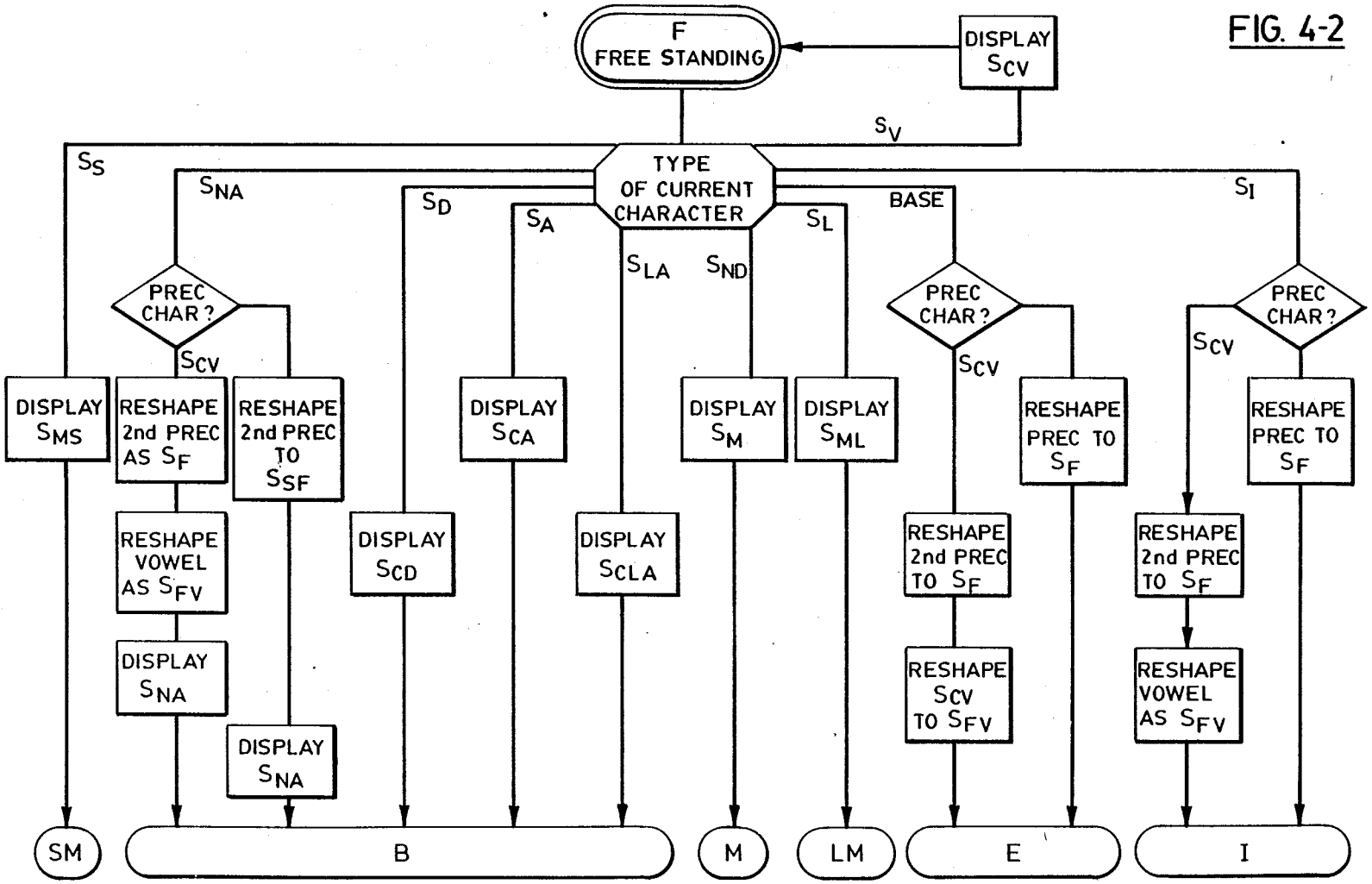
Figures 3, 4:
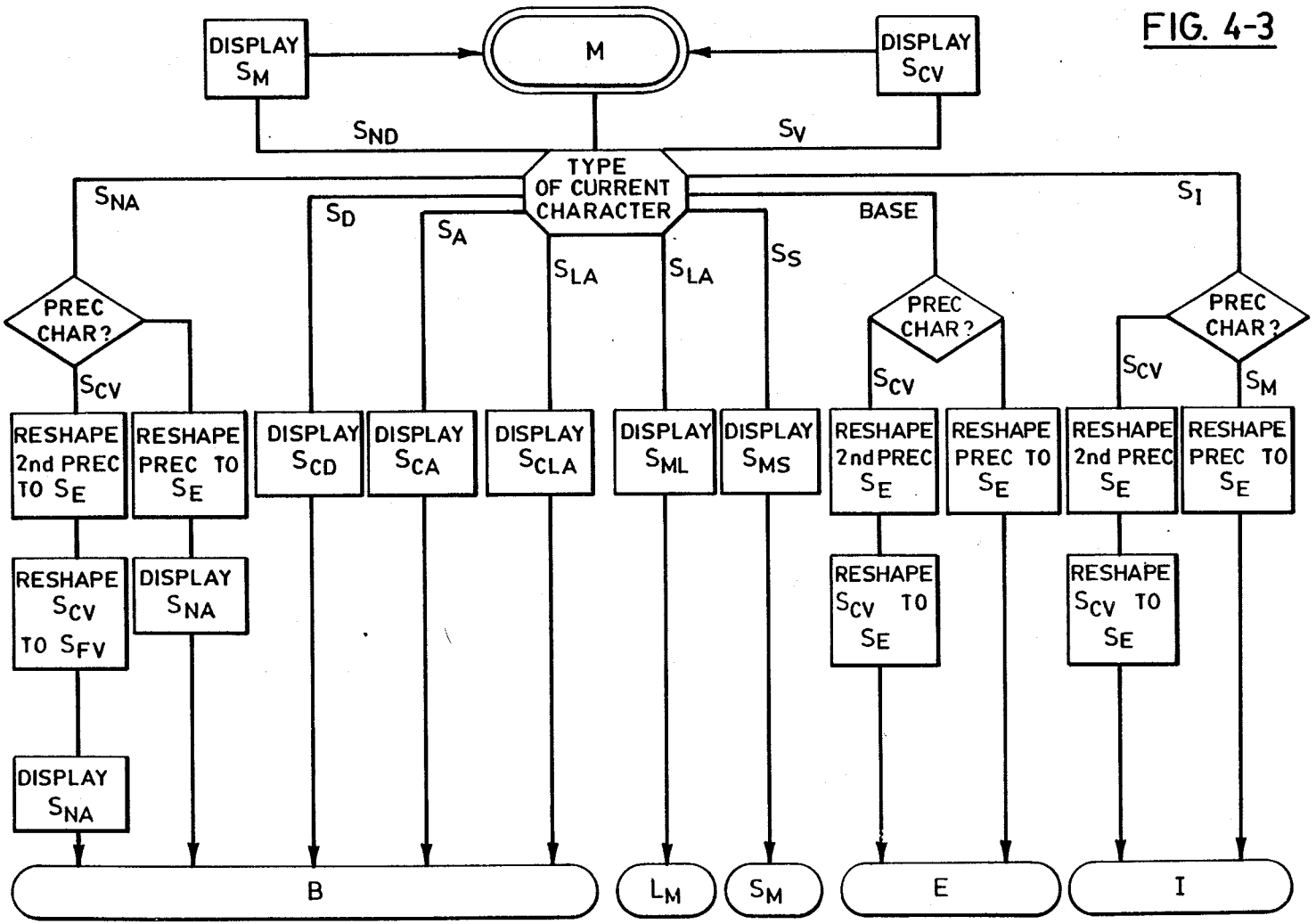
Figure 4:
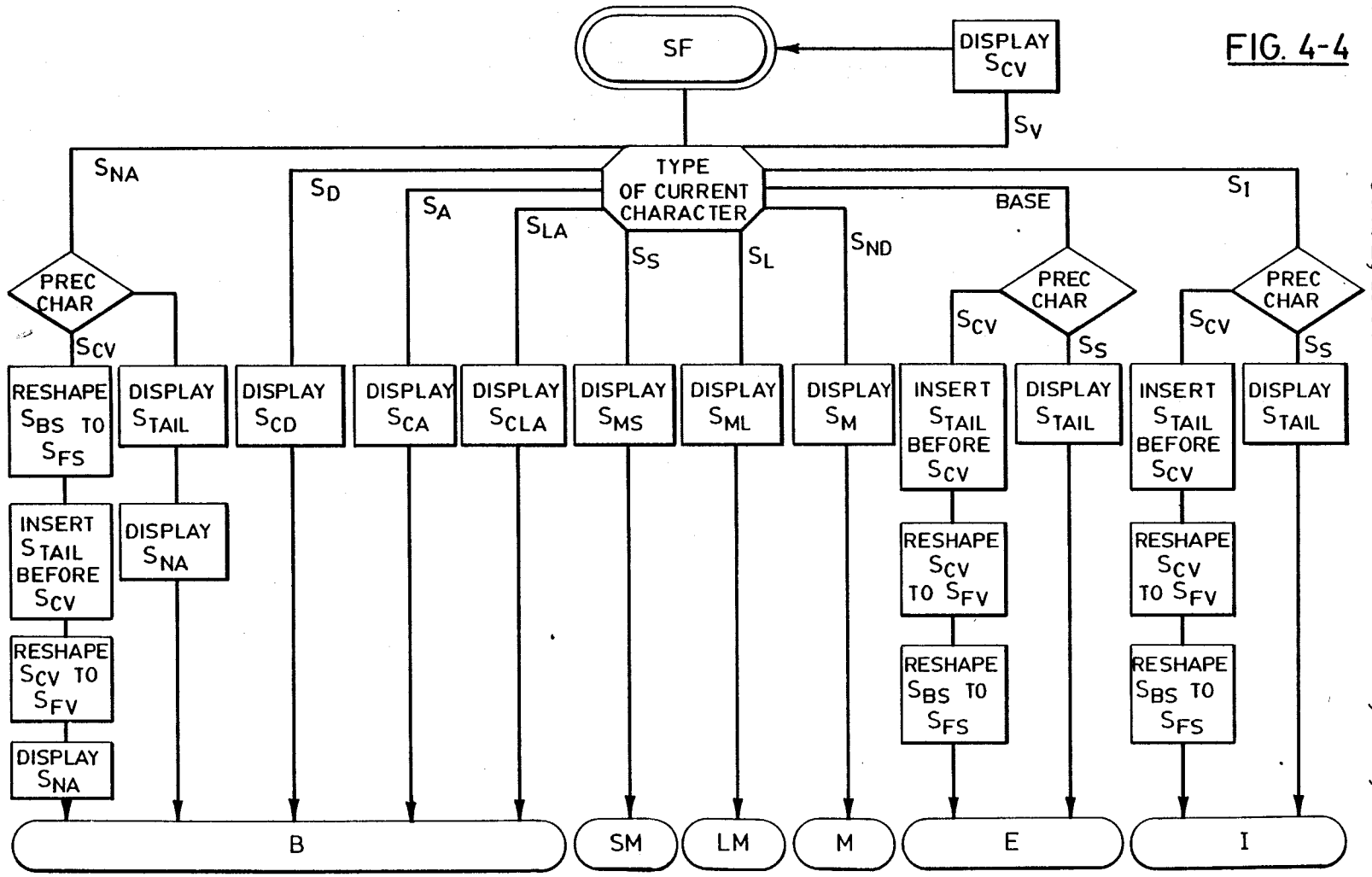
Figures 4, 5:
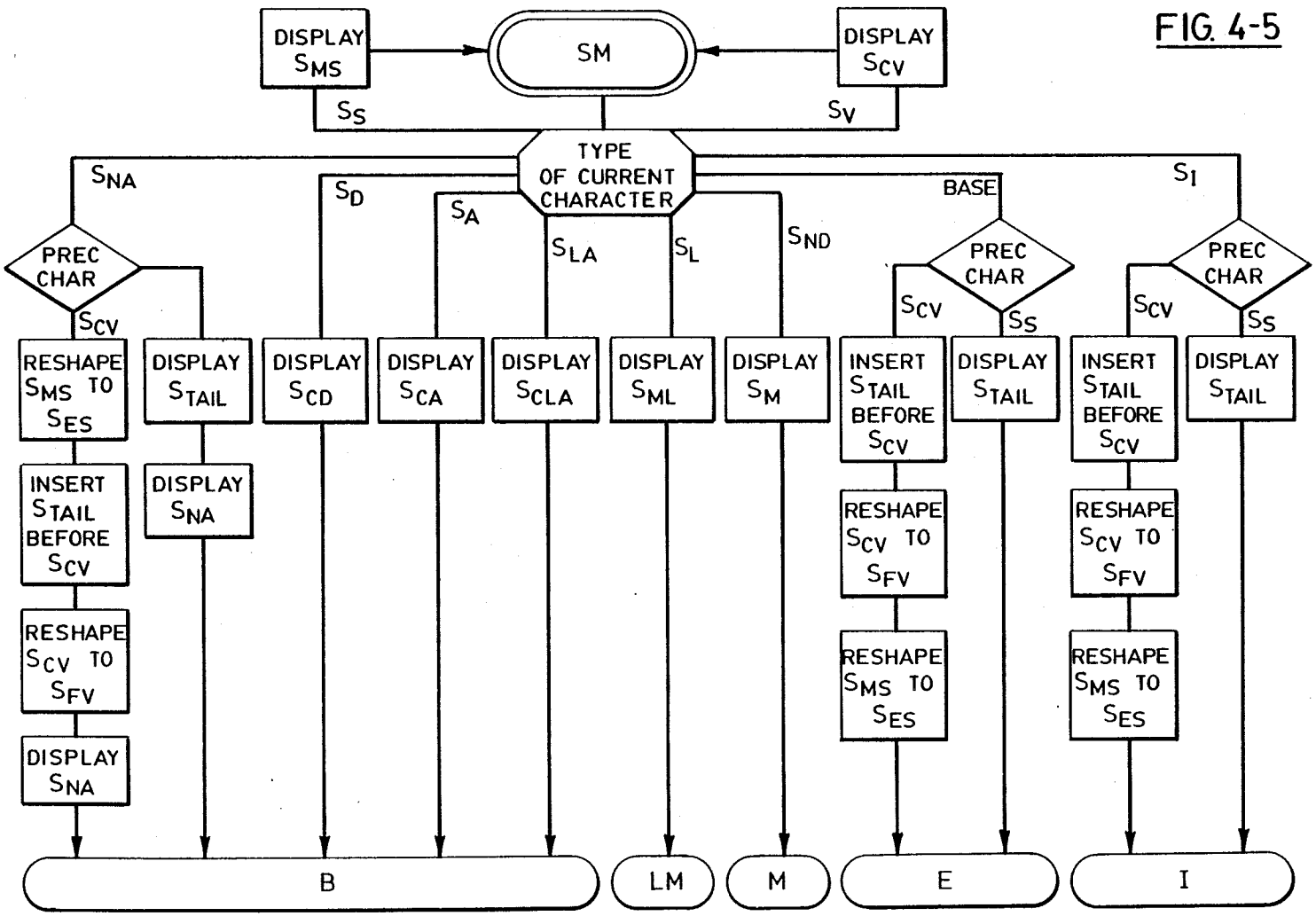
Figures 4, 5, 6:
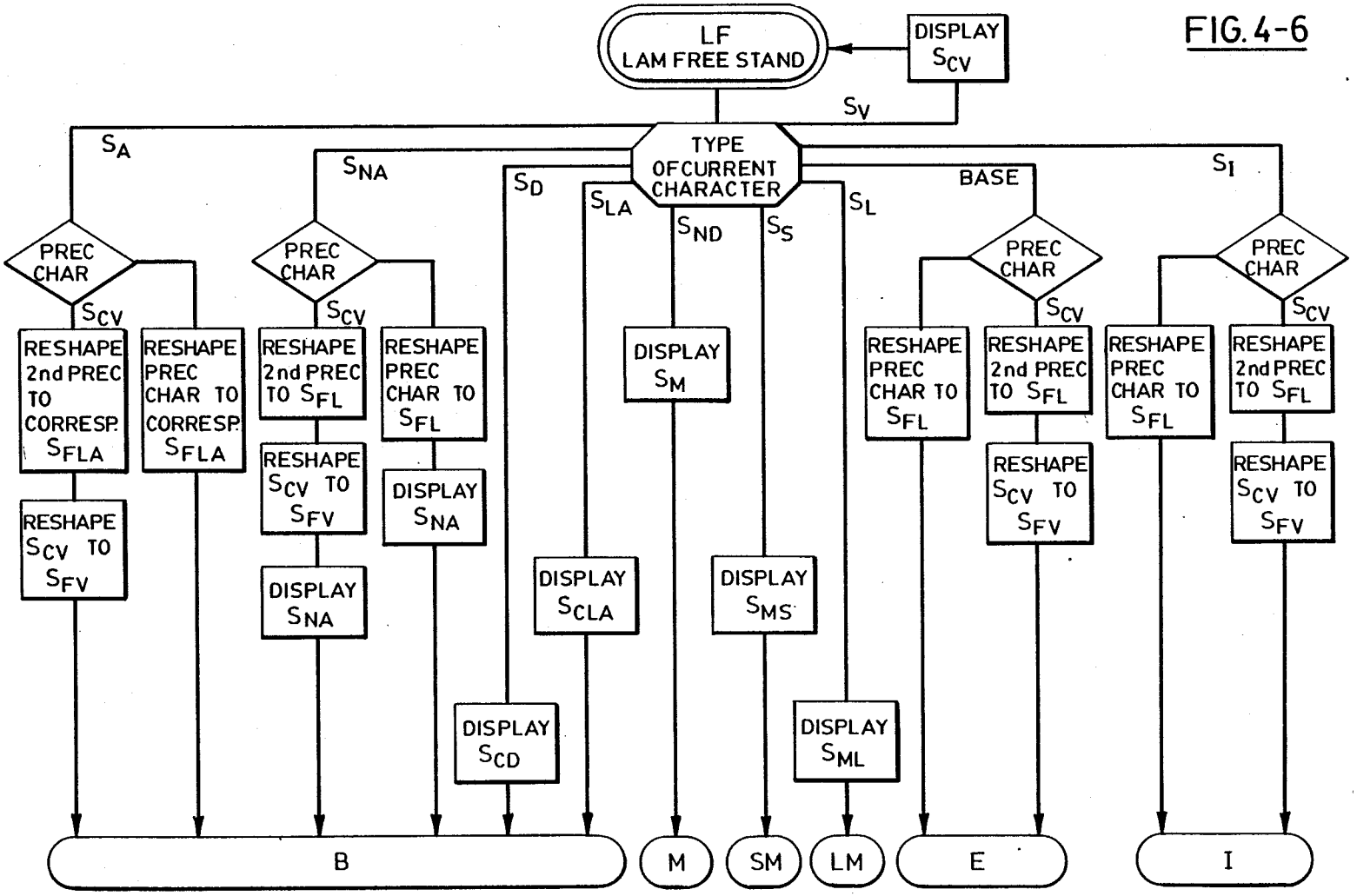

The set $S_{ND}$, which contains most of the alphabet, can be written in the $P_B$, $P_M$, $P_{EW}$, and $P_F$ positions of an Arabic word. It has the following shape groups:

$S_{BND}$—Set of non-dividing shapes used in the beginning of part position $P_B$ $S_{MND}$—Set of non-dividing shapes used in the middle-of-part position $P_M$ $S_{FND}$—Set of non-dividing shapes used in the free-standing position $P_F$ $S_{END}$—Set of non-dividing shapes used in the end-of-word position $P_{EW}$ The set of dividing characters, $S_D$, can be written only in the positions $P_P$ and $P_{EP}$ of an Arabic word and consists of the following shape groups:

$S_{FD}$—Set of stand-alone dividing shapes that can be used in position $P_P$ $S_{CD}$—Set of connectable dividing shapes that can be used in position $P_{EP}$ The set of vowels, $S_V$, can be used after any of the above shapes in any of the positions. This vowel set has only the following two shape groups:

$S_{FV}$—Set of stand-alone vowels (vowels without a hyphen), which can be used after the characters in the positions $P_{EW}$, $P_F$, $P_P$, and $P_{EP}$ $S_{CV}$—Set of connectable vowels (vowels on a hyphen) which can be used after the characters in the positions $P_B$ and $P_M$ only With reference to FIG. 6, examples of Arabic words, having all the different positions and shapes above-defined, are given.

The production rules for writing Arabic words can be derived in terms of the above-defined groups of Arabic character shapes, using Backus-Naur form, as follows. (Recall that Arabis is written from right to left).

| | | |
|---|---|---|
| | | ← $R_3$ → |
| Arabic Word | :: = | <$V_F$><$S_{END}$><TEXT 1>\| |
| | | ← $R_4$ → |
| | | <$V_F$><$S_{FND}$><TEXT 2>\|<$V_F$><TEXT 2> |
| | | ← $R_1$ → |
| TEXT 1 | :: = | <$V_C$><$S_{BND}$>\|<$V_C$><$S_{BND}$><TEXT 2>\| |
| | | ← $R_7$ → |
| | | <$V_C$><$S_{MND}$><TEXT 1> |
| | | ← $R_5$ → |
| TEXT 2 | :: = | λ\|<$V_F$><$S_{FD}$>\|<$V_F$><$S_{FD}$><TEXT 2>\| |
| | | ← $R_6$ → |
| | | <$V_F$><$S_{CD}$><TEXT 1> |
| $V_F$ | :: = | λ\|<$S_{FV}$> |
| $V_C$ | :: = | λ\|<$S_{CV}$> |

λ = null character

Figures 4, 5, 6, 7:
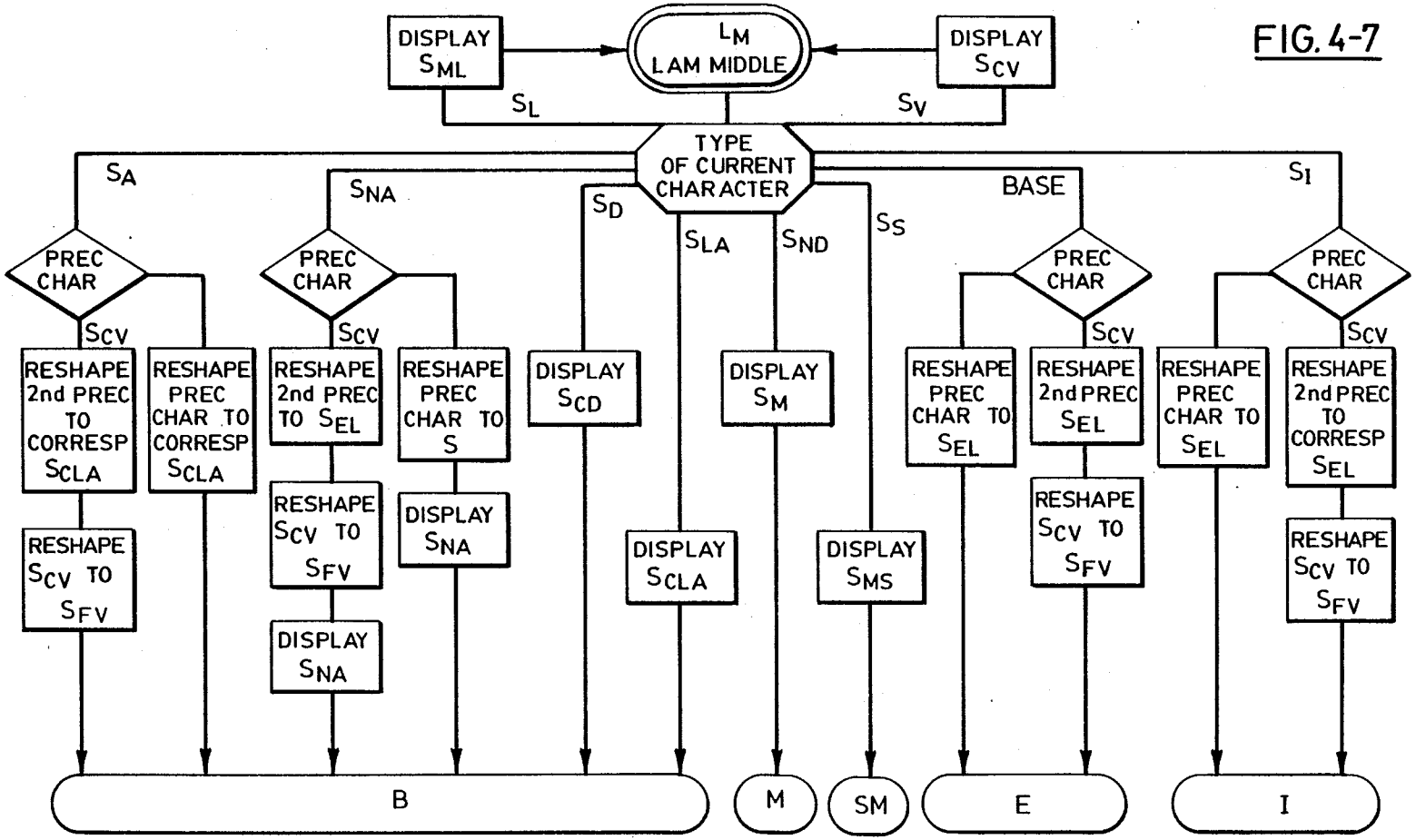
Figures 4, 5, 6, 7, 8:
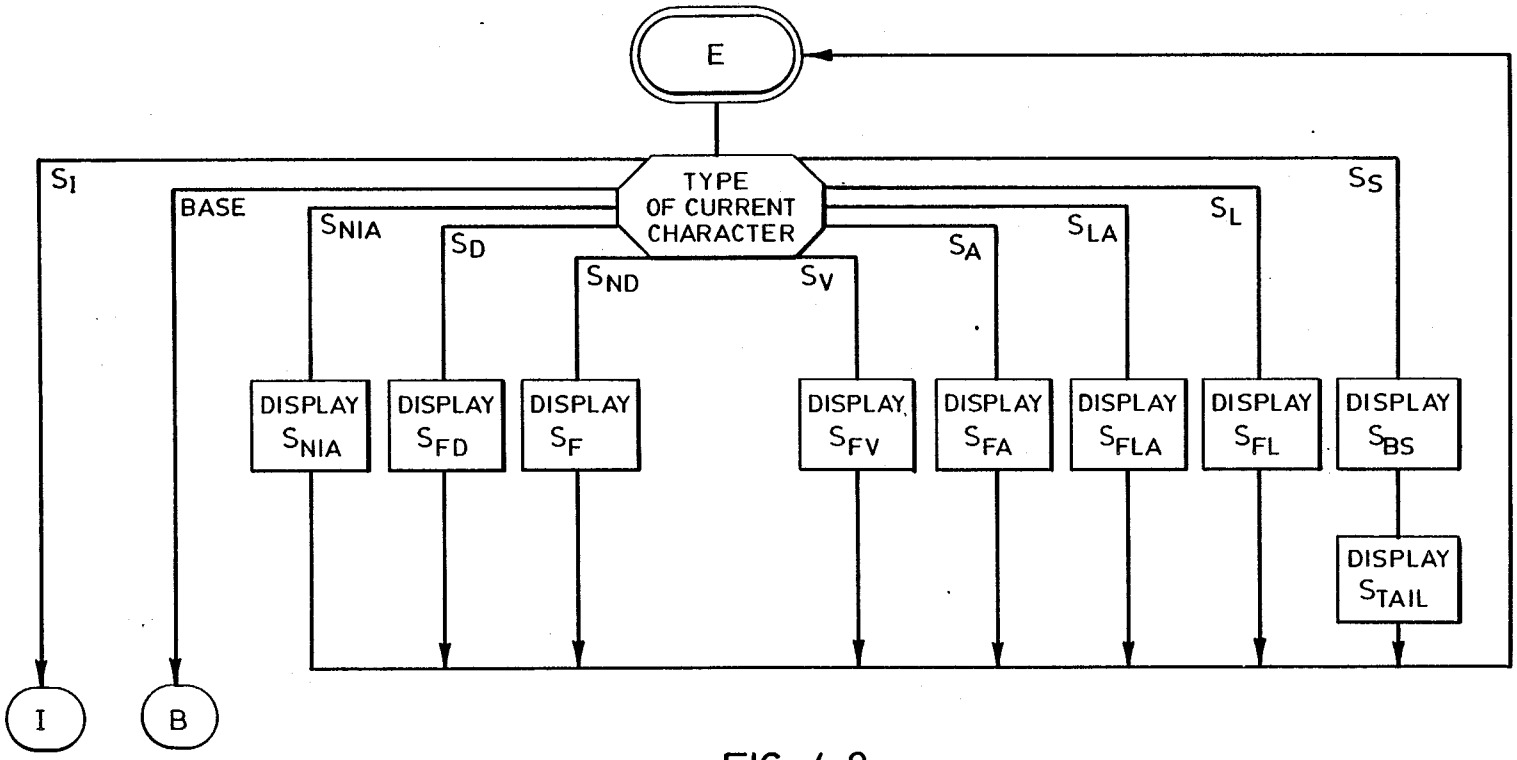
Figures 4, 5, 6, 7, 8, 9:
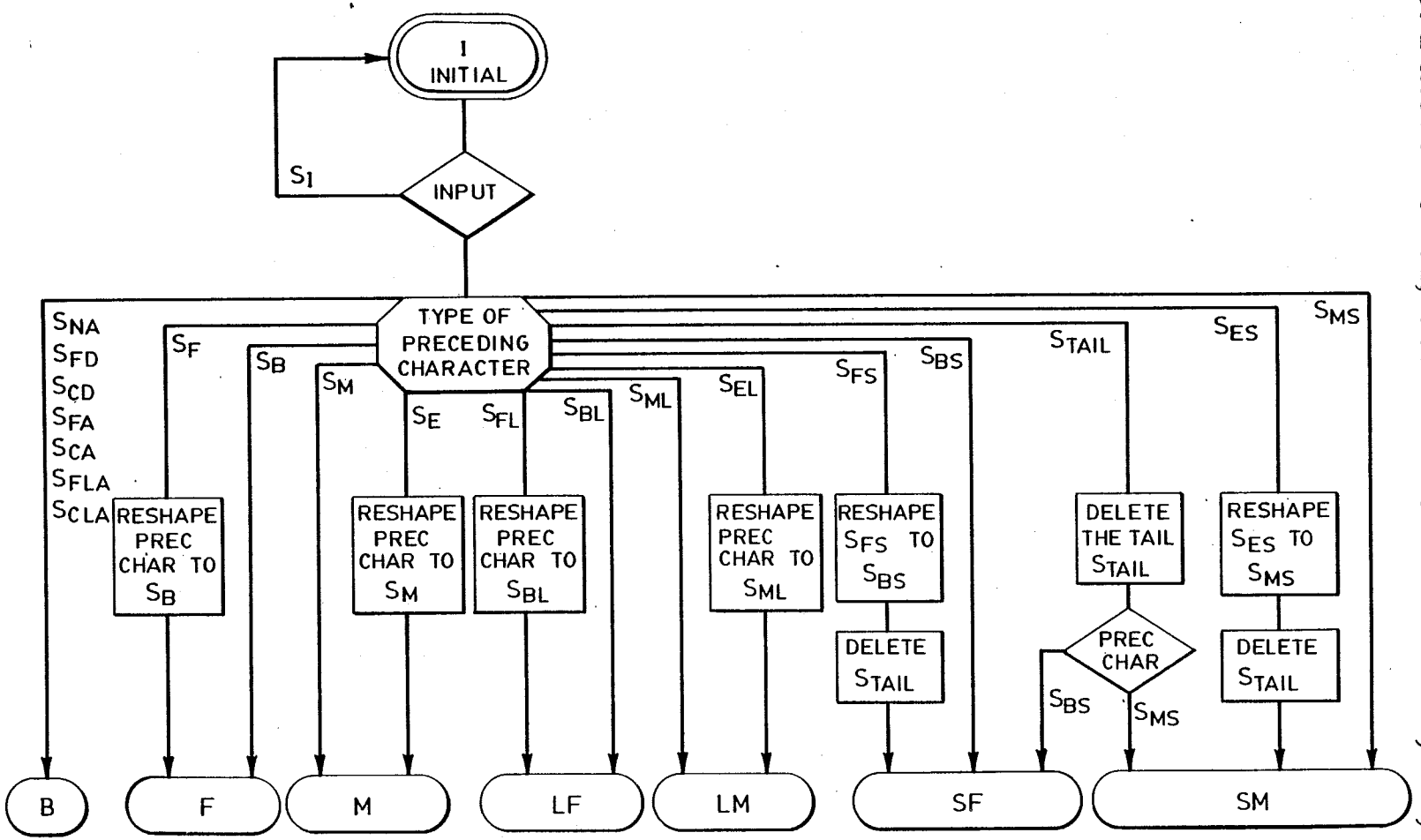
Figures 4, 5, 6, 7, 8, 9, 10:
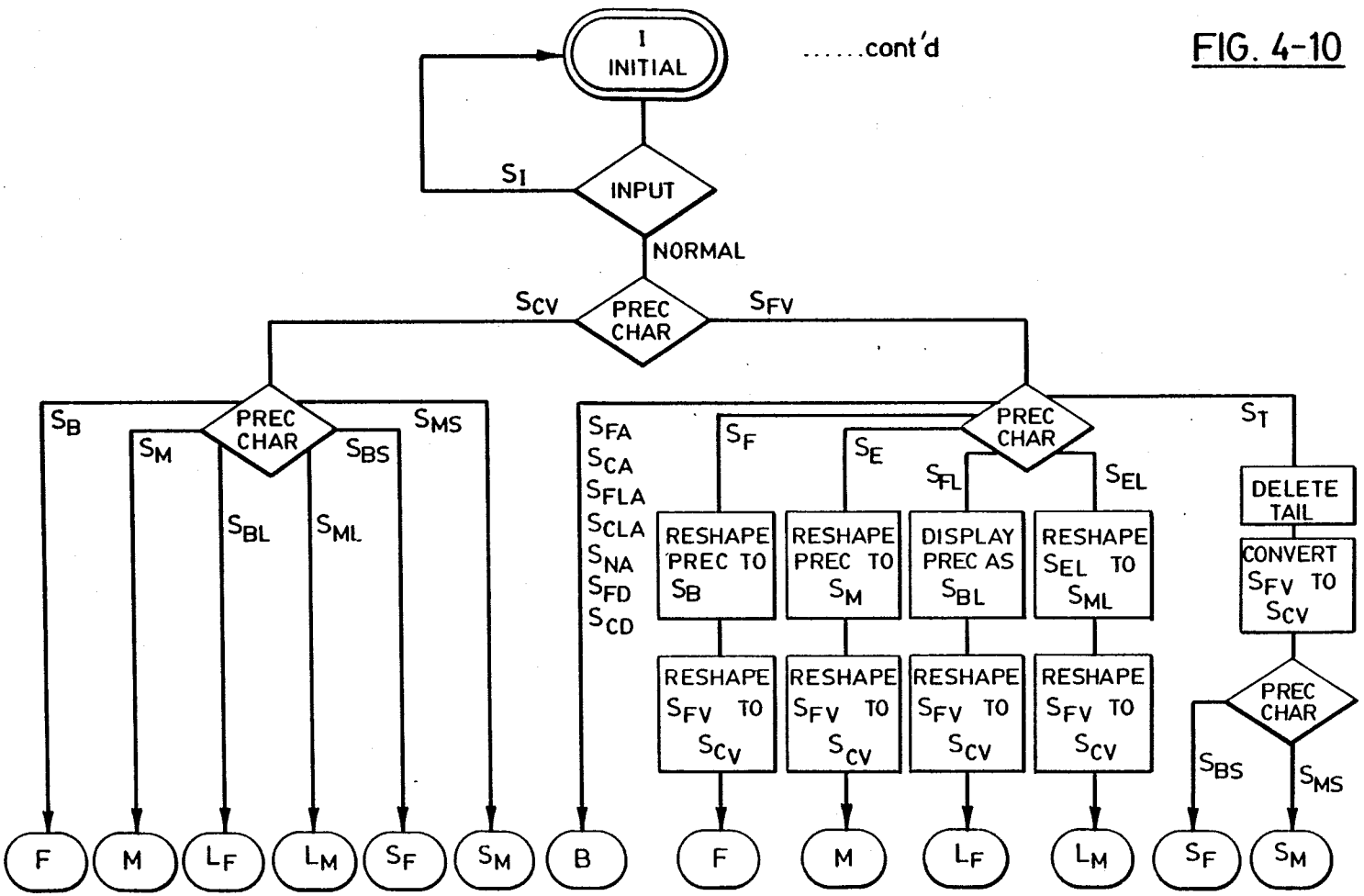
Figure 5:
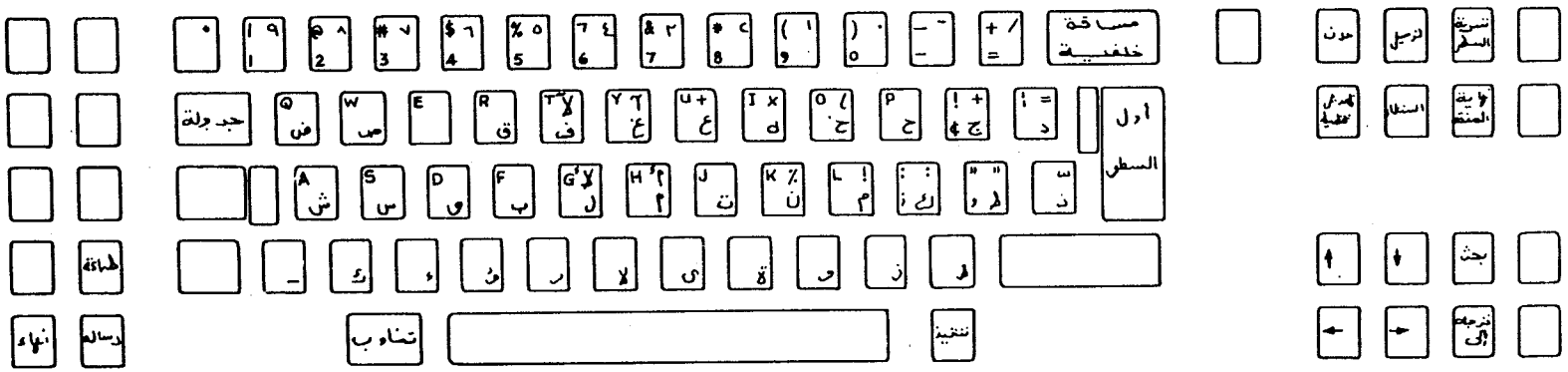
Figure 6:
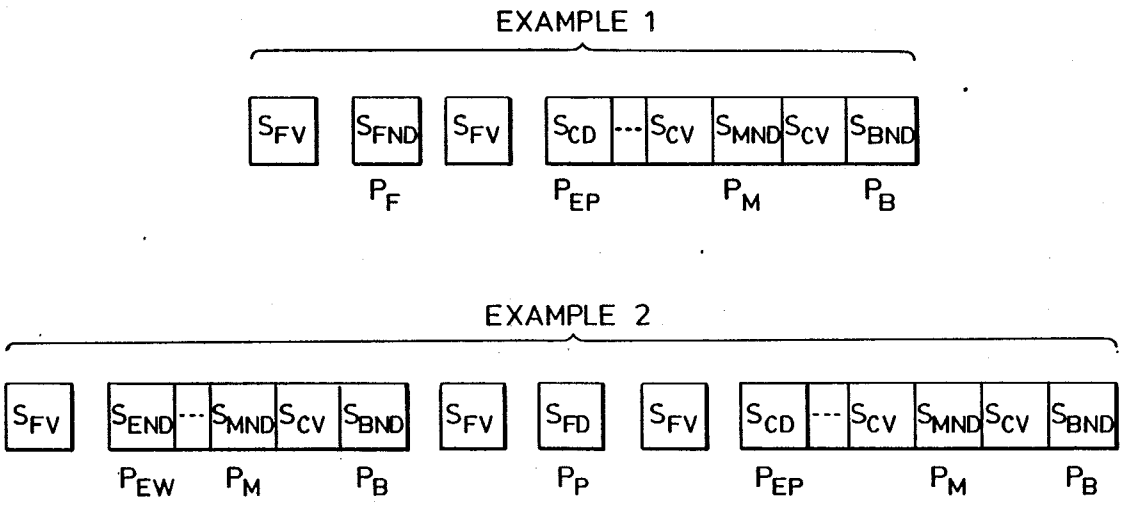
Figure 7:
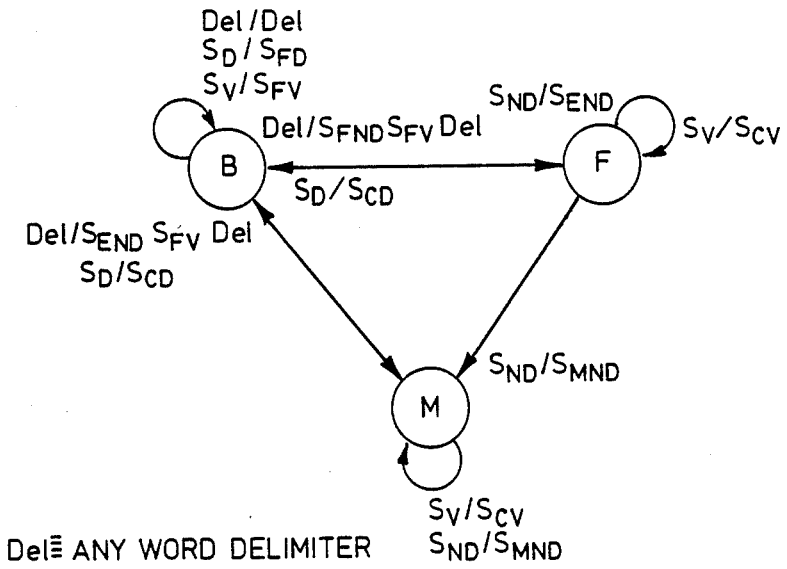
Figure 8:
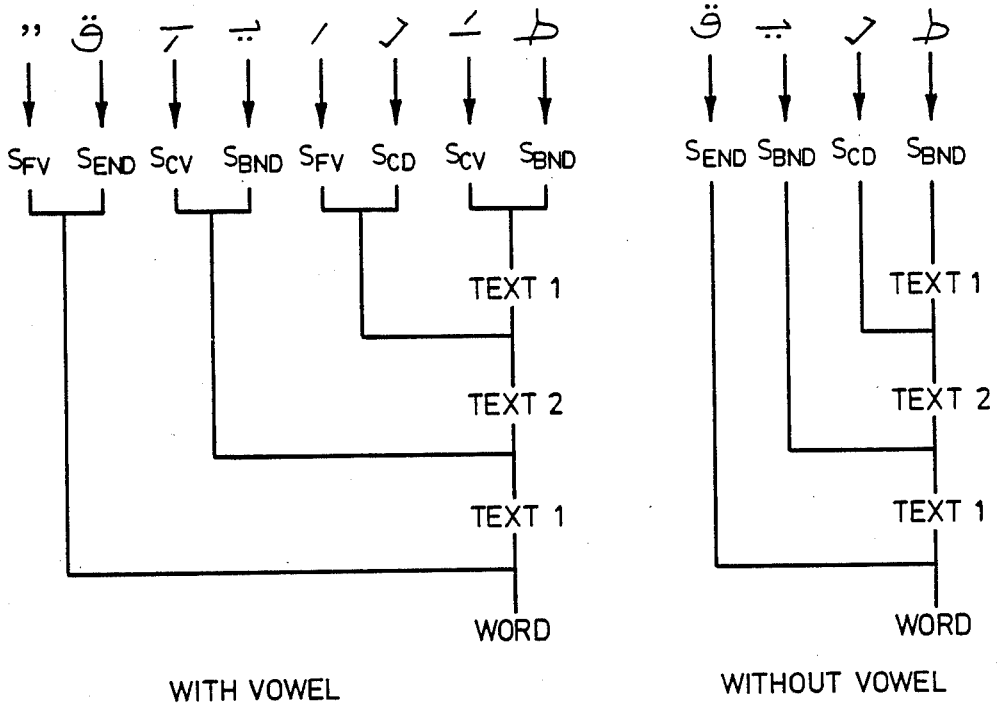

Turning to FIG. 8, Arabic words are illustrated showing how they can be defined using the above rules.

FIG. 8 is an example showing how an Arabic word could be parsed using the given production rules set out above. The word used in TAREEQ which means road. The word is shown twice, once with and once without vowels to illustrate the rules in both cases. The right hand side of the figure is the version of the word having no vowels.

The first character, from right to left, is selected from the set $S_{BND}$ and and is equal to TEXT 1. The second character is selected from the set $S_{CD}$. From the above equations R6, TEXT 1 followed by $S_{CD}$ equals TEXT 2.

The third character is selected from the set $S_{BND}$ since it is in a beginning of part position. The fourth character is selected from the set $S_{END}$ due to the fact that the character is placed in the word ending position.

The left hand side of FIG. 8 is illustrative of the building of the same word, but with the vowels included. The considerations are the same except that each character is grouped with its associated vowel.

These formal production rules can be restated as:

Rule 1 ($R_1$)—Dispplay beginning-of-part shape of a non-dividing character
(a) at beginning of a part, or
(b) after a word dividing character.

Rule 2 ($R_2$)—Display middle-of-part shape of a non-dividing character after a beginning-of-part, or a middle-of-part shape.

Rule 3 ($R_3$)—Display end-of-word shape of non-dividing character if at end of word and after beginning-of-part or middle-of-part shapes.

Rule 4 ($R_4$)—Display stand-alone shape of non-dividing character if:
(a) stand-alone character, or,
(b) at end of word and after a word-dividing character Rule 5 ($R_5$)—Display stand-alone shape of a word dividing character (or a vowel):
(a) at beginning of a part, or
(b) after a word dividing character Rule 6 ($R_6$)—Display the connectable shape of a word dividing character (or a vowel):
(a) after a beginning-of-part, or
(b) after a middle-of-part The Finite-State machine noted hereinabove should have at least three states, namely, stand-alone (F), (from Rules $R_3$, $R_4$, $R_5$, and $R_6$), middle-of-part (M), (from Rule $R_2$), and beginning-of-part (B), (from Rule $R_1$).

FIG. 7 shows the state transition diagram of the Finite-State machine. For example, if the machine is at the beginning-of-part state,(B) and a character from $S_{ND}$ is keyed, the beginning-of-part shape of this character $S_{BND}$ will be displayed. The machine will then switch to the stand-alone state (F). The next character to be keyed will determine whether the machine should go back to the beginning-of-part state (B), switch to the middle-of-part state (M), or remain in the stand-alone state (F).

If another character $S_{ND}$ is keyed, the machine will produce its middle-of-part shape, $S_{MND}$, and switch to the middle-of-part state (M). A delimiter will cause the machine to switch to the beginning-of-part state (B), reshape the preceding character from middle-of-part $S_{MND}$ to the final shape $S_{END}$, and finally produce the delimiter itself.

The above rules constitute what may be termed a first level of operation for the handling of all normal characters.

It will be understood, however, that the present implementation is expandable, and this is illustrated in respect of the additional levels incorporated to handle compound shapes and special end-of-word/stand-alone shapes.

COMPOUND SHAPES

The Arabic script has a unique shape called LAM-ALEF which is a compound shape of ALEF and LAM.

The original alphabet does not include LAM-ALEF as one of its characters, but over the years, LAM-ALEF became common usage to replace the separate characters LAM and ALEF. Conventional typewriters and keyboards support this compound shape LAM-ALEF as a single character.

With the described implementation of the present invention, the two characters, LAM followed by ALEF will always be replaced by the compound form LAM-ALEF.

By definition:

$S_L$—Subset of $S_{ND}$ that includes LAM.

$S_A$—Subset of $S_D$ that includes ALEF.

$S_{LA}$—Subset of $S_D$ that includes the corresponding LAM-ALEF compound character.

$S_{BL}$—Subset of $S_{BND}$ that has begin-of-part shapes for $S_L$ $S_{ML}$—Subset of $S_{MND}$ that has middle-of-part shapes for $S_L$ $S_{EL}$—Subset of $S_{END}$ that has end-of-word shapes for $S_L$ $S_{FL}$—Subset of $S_{FND}$ that has stand-alone shapes for $S_L$ $S_{LA}$—Subset of $S_{CD}$ that has the connectable shape of $S_{LA}$ $S_{FLA}$—Subset of $S_{FD}$ that has the stand-alone shape of $S_{LA}$ So, the production rules for this special case can be written as:

$$\left.\begin{matrix} S_A V_C S_{BL} \\ S_A V_C S_{FL} \end{matrix}\right\} \longrightarrow V_F S_{FLA}$$

$$\left.\begin{matrix} S_A V_C S_{ML} \\ S_A V_F S_{EL} \end{matrix}\right\} \longrightarrow V_F S_{CLA}$$

where, $$<V_C> ::= \lambda \mid <S_{CV}>$$

$$<V_F> ::= \lambda \mid <S_{FV}>$$

This special case can be stated verbally as

Rule 7 ($R_7$)—If Begin-of-part shape of LAM is followed by one of the ALEF shapes, replace both of them to the corresponding shape of stand-alone LAM-ALEF.

Rule 8 ($R_8$)—If Middle-of-part shape of LAM is followed in one of the ALEF shapes, replace both of them to the corresponding shape of connectable LAM-ALEF.

SPECIAL-END-OF-WORD/STAND-ALONE SHAPES

The shapes of Arabic characters have different widths. Some of the shapes of some characters are actually double the width of other shapes of the same characters. However, available display terminals are provided with fixed size dot matrices and to produce an le script, some shapes are necessarily produced over two dot matrices (i.e., two hex codes are required to represent these shapes). These are the end-of-word and stand-alone shapes of the Arabic characters SEEN, SHEEN, SAD and DHAD. These shapes differ in the first hex code, and share the second which is a common "tail" for all of them.

Let us define:

$S_{TAIL}$—the tail character $S_{NA}$—set of non-alphabetic characters (numerics, Latin, special characters, space, . . . )

$S_I$—set of interrupt keys (cursor motion keys, ENTER, CANCEL, LF/CR, . . . , etc.)

$S_S$—Subset of $S_{ND}$ that contains these four character (SEEN, SHEEN, SAD and DHAD)

$S_{BS}$—Subset of $S_{BND}$ that has beginning-of-part shapes for $S_S$ $S_{MS}$—Subset of $S_{MND}$ that has middle-of-part shapes for $S_S$ $S_{FS}$—Subset of $S_{FND}$ that has stand-alone shapes for $S_S$ (to be used with $S_{TAIL}$)

$S_{ES}$—Subset of $S_{ENd}$ that has end-of-word shapes for $S_S$ (to be used with $S_{TAIL}$)

The production rule for these shapes would be:

$$T\ V_C\ S_{BS} \rightarrow T\ V_F\ S_{TAIL}\ S_{FS}$$

$$T\ V_C\ S_{MS} \rightarrow T\ V_F\ S_{TAIL}\ S_{ES}$$

where, $$<T> ===<S_{NA}> \mid <S_I>$$

$$<V_C> ===\lambda \mid <S_{CV}>$$

$$<V_F <===\lambda \mid <S_{FV}>$$

These rules can be described as:

Rule 9 ($R_9$)—If the beginning-of-part shape of any of the characters (SEEN, SHEEN, SAD or DHAD), is followed by a word-delimiter then re-shape it to the first half of the corresponding stand-alone shape, and insert the tail character as the second half.

Rule 10 ($R_{10}$)—If the middle-of-part shape of any of the characters (SEEN, SHEEN, SAD or DHAD), is fdllowed by a word-delimiter then re-shape it to the first half of the corresponding end-of-word shape, and insert the tail character as the second half.

In order to handle these two special cases, more states have to be added to the finite state machine. More specifically, four more states need to be added. They are:

$L_F$—Stand-alone state-for LAM (from Rule 7)

$L_M$—Middle-of-part state for LAM (from Rule 8)

$S_F$—Stand-alone state for SEEN, SHEEN, SAD, and DHAD (from Rule 10)

$S_M$—Middle of part state for SEEN, SHEEN, SAD and DHAD (from Rule 10)

To add these four states to the finite state macnine of FIG. 7 will produce a complex diagram. Thus, reference is made instead to FIGS. 4-1 to 4-7 for a clearer understanding of the operation of the finite state machine that produces the script of all those levels of operation.

For example, FIG. 4-1 shows the operations of the finite state machine when it is in the beginning-of-part state and receiving the different types of input characters. The operations are explained in terms of the processing done on the input character (output) and the new position in the word (state transition).

FIGS. 4-1 through 4-7 show the operations of the disclosed system in each of its states. All these Figures are designed in the same manner starting with the current state of the machine at the top of the chart and having the resultant states at the bottom of the chart. The first thing done is to check the incoming character to determine which of the chart branches should be followed. Only one branch will be followed until the next state is determined. Each branch shows the operations that take place on the incoming character, including the checking or the reshaping of other characters. The last operational step is to switch to the proper NEXT state, which is the end of the chosen branch. In some cases, this state is of the same value as the current state, i.e. the system will stay in the same state, in this case the branch ends at the top of the chart into the top state box.

These charts are very similar to computer flow charts and should be self-explanatory once the above conventions are understood.

However, as an example, a more detailed description will be given for FIG. 4-1 to make sure the reader will be able to follow the other charts without difficulty.

FIG. 4-1 is for the operations of the system when it is in state B.

The first step is to check the class of the incoming character at this time.

If the class is $S_{NA}$, then display it without modification and stay in state B.

If the class is $S_D$, then display the $S_{FD}$ shape of that character and stay in the same state B.

If the class is $S_{LA}$, then display the $S_{FLA}$ shape of that character and stay in state B.

If the class is $S_{ND}$, then display the $S_{BND}$ (begin-of-part) shape of this character and go to state F.

If the class is $S_L$, then display the $S_{BL}$ shape of the character and switch to state LF.

If the character is $S_S$, then display $S_{BS}$ shape and go to state SF.

If the character is BASE which is a control key, then do not display any character. Just change the system state to the E state.

If the character is SI, then no display will take place. However, the system will switch to the I state.

If the character is $S_A$, then display the $S_{FA}$ shape and stay in state B. And finally, if the character is a vowel $S_V$, then display the $S_{FV}$ shape of it and stay in the same state B.

In FIGS. 4-2 through 4-7, it is understood that the same approach is used as with FIG. 4-1 and one skilled in the art may determine the state of the machine by following the appropriate path as in FIG. 4-1.

There are three cases that are common in these charts and do not exist in 4-1. These are:

(1) the end of the word handling which exist when the incoming character is $S_{NA}$, BASE, or $S_I$;

(2) the combined character which happens when the incoming character is $S_A$ and the current state is LF or LM (FIGS. 4-6 and 4-7); and (3) the special end when the incoming character is $S_{NA}$, BASE, or $S_I$ and state is SF or SM (FIGS. 4-4 and 4-5).

Figure 3:
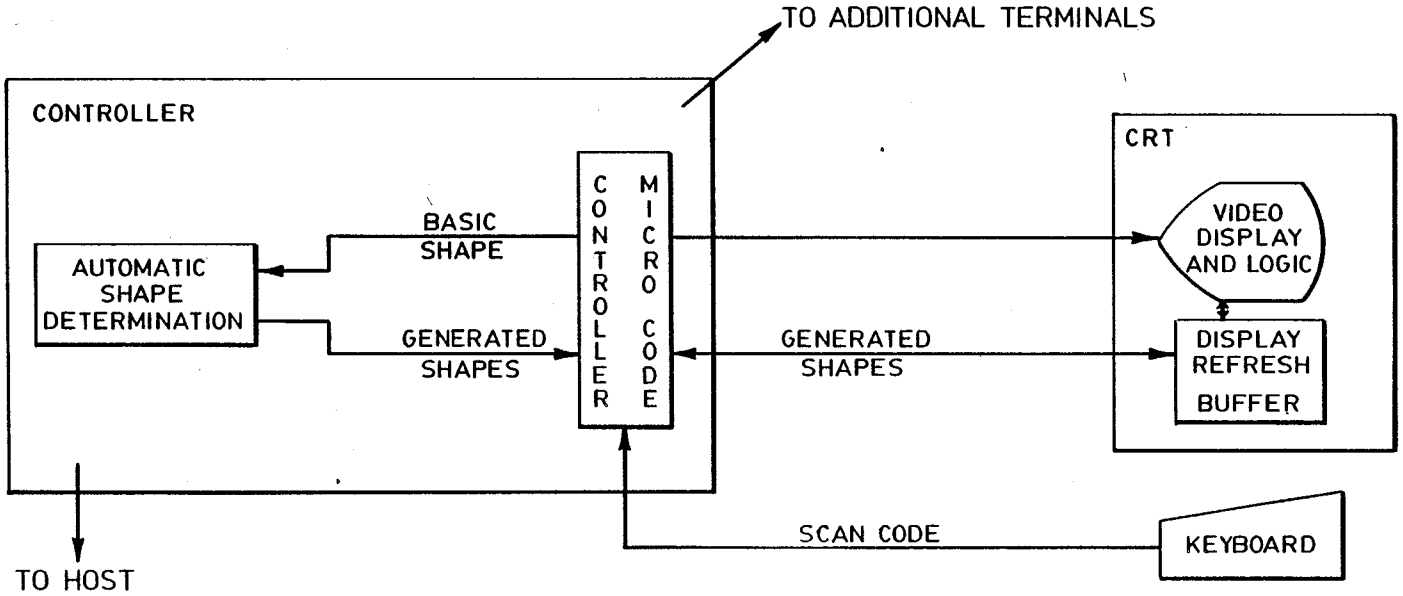
FIG. 3 is a block schematic of a conventional terminal controller embodying the invention.

In the first case (e.g. FIG. 4-3) if the input is $S_{NA}$, the preceding character (which is the last character in the word, since $S_{NA}$ is a non-Arabic) may need to be re-shaped to the end of word shape. FIG. 4-3 is for state M which implies that the preceding character is of $S_{MND}$ type. The chart shows how this character will be changed to $S_{END}$, then the $S_{NA}$ will be displayed. If the character has an associated vowel, it will also be re-shaped to the end of word shape which is $S_{FV}$. The chart shows the same happening if the incoming character is BASE or $S_I$.

The second case is shown in FIGS. 4-6 and 4-7. FIG. 4-6 is used as an example here. If the incoming character is $S_A$, then it should be combined with the preceding character (LAM) into a ligature called LAM-ALEF. The chart shows how this takes place. The preceding character is reshaped to $S_{FLA}$ and the $S_A$ is NOT displayed, i.e. the cursor does not move. If the preceding character has a vowel, it will also be reshaped to $S_{FV}$.

FIG. 4-7 does the same thing. However, $S_{CLA}$ is displayed instead of $S_{FLA}$ since the state here to LM (which is for connected LAM).

The third case (special end) is like the first with the exception that an extra step is required. The SM state (FIG. 4-5) is used as example which matches the choice of state M, in the first case. Here if the incoming character is $S_{NA}$, BASE, or $S_I$, then the preceding character needs to be reshaped from $S_{BS}$ to $S_{ES}$. Then a TAIL will be displayed to that character STAIL. And finally, the associated vowel, if existent, will be reshaped to $S_{FV}$. The incoming character itself will be displayed if $S_{NA}$.

From these figures, it can be easily understood that this algorithm is not checking preceding characters, nor re-shaping them unless at end of a word. This in turn results in better human factors and performance than systems heretofore available.

Appendix B shows several examples of the script generated by this implementation. The examples cover both the general and the special cases as well as the vowels.

It is not believed necessary to elaborate further on the collective FIG. 4, since those skilled in this art will readily appreciate the operations illustrated thereby.

BASIC FUNCTION KEY

In order to be able to produce initials and acronyms in Arabic, a function key, designated BASE, and a new state, termed E, must be added. The function of the BASE key is to enable the generation of adjacent stand-alone shapes of the Arabic characters. When the BASE key is depressed, the Finite State machine switches to the "E" state. All subsequent Arabic characters including $S_S$ will be shaped in their stand-alone shape until the BASE Key is depressed again. FIGS. 4-8 shows the operations of the Finite State machine when it switches to the "E" state. While in this state, the rules relating to LAM-ALEF will be suspended.

DELETE/INSERT/REPLACE

The Finite State machine memorizes the position in the word (i.e., the state) and uses memorized positions for acting on the input characters. In a text editing application, and even in a normal DP environment, the memory of that Finite State machine may be lost in cases such as:

(i) using the backspace (delete key)

(ii) moving the cursor to another position on the screen (iii) end the editing function, . . . , etc.

In order to re-initialize the Finite State machine memory and continue the operation in the new position, the machine has to check the preceding character(s). (In the special case of Rules 7, 8, 9 and 10 (supra), two preceding characters have to be checked). However, since changing the editing position is not the general case during editing of the text, then the present system still conforms to its objectives of minimizing the need for checking preceding characters.

An additional state, termed "I", is added to the Finite State machine, and it is to this state that the machine will switch when its memory is lost. It will stay in this state until an "editable" character is keyed. At this time, the machine will re-initialize its memory by checking preceding characters. This will make the Finite State machine switch to one of the previously defined states.

The handling of insertion/deletion/replacement of characters inside words is done by first re-initializing Finite Machine memory and then through the "I" state (if memory is lost). Secondly, the same operations described before will be performed. The difference is that instead of processing characters coming from the keyboard, the machine will re-shape characters already available in the buffer (as succeeding characters). The re-shaping of the succeeding characters will be performed until the end of the part where the insertion/replacement/deletion took place.

IMPLEMENTATION

The procedure described above has been implemented in an IBM* Displaywriter (*Registered Trade Marks), a text processing machine. The system as implemented is outlined by the block diagram of FIG. 1, and is explained below.

1. The keyboard has the basic shapes of the characters and also the vowels. The keyboard layout is shown in FIG. 5. The procedure is not, of course, restricted to a specific layout.

2. The output of the keyboard is initiated by key strokes (scan codes) and the Keyboard Access Method (KAM) processes the scan codes to produce EBCDIC standard codes for the basic Arabic shapes. These codes are shown circled in Appendix A.

3. These Arabic basic shapes are processed by the text processing software up to the point where it is ready to be stored in the text processing buffer.

4. The "Automatic Shape Determination" block represents the logic of the algorithm. The input to that block is EBCDIC codes of the basic shapes of the characters. The output is the EBCDIC codes of the generated shapes. These are all the Arabic codes shown in Appendix A, including the circled basic shapes. Implementing the procedure in the IBM Displaywriter is mainly done by following the character classifications, and the Finite State machine operations described before.

Appendix C shows how the Arabic shapes of the IBM Displaywriter are assigned to the groups defined by the algorithm.

Every class has been given a hex code. For example, hex 05 for $S_{FA}$, hex 06 for $S_{CA}$, . . . , etc. These hex codes are stored in a table of 256 entries. So by simple indexing, the EBCDIC code of the character can point to the entry in that table that has the value of its class. Once the class number is known, and the state of the finite state machine is known, then one of the flow charts of FIGS. 4-1 to 4-10 would be followed to process this character.

In order to find the corresponding shape for one of the input or preceding characters, the following technique is followed:

a. Each class is represented by an array in the memory.

b. Each array will have a number of entries equal to the number of characters in this class.

c. The entry of a character is its EBCDIC code.

d. Entries are stored so that the different shapes of a character have the same relative position from the start of their table (e.g., the second entry in $S_{BS}$ table will have the beginning-of-part shape of the character and its stand-alone shape is the second entry in the $S_{FS}$ table).

e. To find the corresponding shape of an input character, search in the stand-alone table until the character is located and determines its relative position in this table. Thus, the corresponding shape can be retrieved simply by indexing to the same relative position in the corresponding table.

Once the corresponding shape is found, the automatic shape determination algorithm will pass it to the text storage buffer manager which will insert that shape in the text storage buffer.

The automatic shape determination will return control to the text processing software which will instruct the display access method to update the display on the video screen (which has a bilingual character generator). At that moment, the operator will see the correct shape on the screen.

The shaping/reshaping of characters takes place during the editing time. Once this operation is done, the generated shapes (readable script) are stored on diskette. Thus, subsequent display or printing does not require any access to the automatic shape determination facilities.

Figure 2:
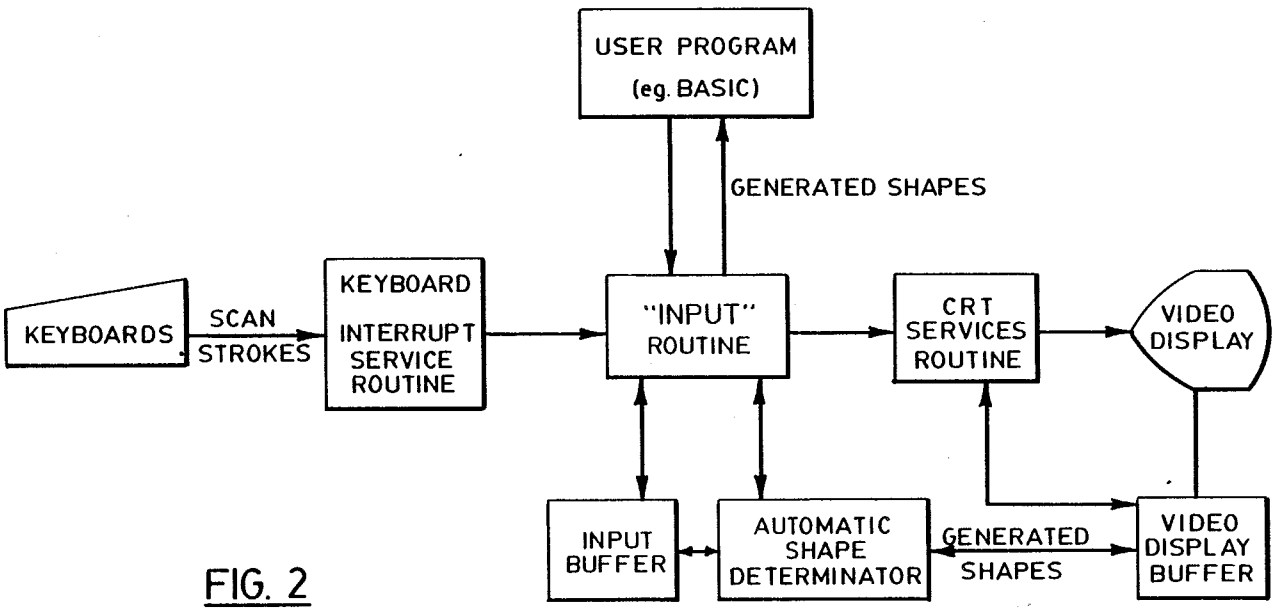
FIG. 2 is a block schematic of a personal computer embodying the invention.

This invention can also be implemented in a personal computer, e.g., the IBM Personal Computer, as suggested by FIG. 2. In this case, the "INPUT" routine of the programming language must be modified/replaced to access the algorithm. The block diagram of FIG. 2 shows the suggested implementation and the required interfaces.

FIG. 3 illustrates the implementation of the invention in a data processing environment. A number of terminals with Arabic character generators can be attached to a terminal controller which will have standard circuitry and logic. The logic of the controller should interface to the algorithm for shaping the input characters. The controller, however, should maintain a different Finite State machine for each of the terminals.

A fourth way to implement this invention would be in the provision of a chip in the H/W circuit of a CRT.

FURTHER IMPLEMENTATION IMPROVEMENT

It is noted that the IBM Displaywriter is using some of the shapes in different positions in the word without affecting the readability or the acceptance of the generated script. In this machine (see Appendix C), many of the shapes in $S_{BND}$ are used also as $S_{MND}$.

This can potentially lead to enhancement to the above discussed implentation. The classes of Appendix C can be further subdivided into smaller sets, while maintaining the characteristics of the original class. This subdividing would be done depending on the number and types of shapes supported for each character.

Appendix D shows this further subdividing as done for the character set of the IBM Displaywriter.

This process, of course, will require the elimination of several shaping/reshaping operations of the flowcharts of FIGS. 4-1 to 4-10, which will make the processing even faster. As an example of this elimination, FIG. 4-4 and FIG. 4-5 may be replaced by any of them. $S_F$ will be equivalent to $S_M$ since $S_{FS}$ is the same as $S_{ES}$. Also, the characters of some groups such as $S_{FND}$ and $S_{FD}$ will have to be shaped/reshaped because they have only one shape.

It must be noted that this further improvement is feasible and is provided by the nature of the process described herein. However, it is machine dependable.

APPENDIX A

ARABIC CHARACTER SET WITH CODE POINTS

| | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0 | | | | | | | | ح | ش | ظ | غ | ك | ؛ | ؟ | × | |
| 1 | | | | | | أ | | خ | | | | ل | | | | |
| 2 | | | | | س | ؤ | ة | خ | | | | لآ | | | | |
| 3 | | | | | ـس | إ | ت | د | | | | لآ | | | | |
| 4 | | | | | ـ | أ | ت | ذ | | | | لأ | | | | |
| 5 | | | | | ـ | ئ | ث | ر | | | | لأ | | | | |
| 6 | | | | | ء | ا | ث | ز | | | | لأ | | | | |
| 7 | | | | | آ | ا | ج | س | | | | لأ | | | | |
| 8 | | | | | آ | ب | ج | س | | | | لا | | | | |
| 9 | | | | | أ | ب | ح | | | | | لا | | | | |
| A | | | | | | | | | ش | ع | غ | ل | ى | | ا | |
| B | | | | | | | | | ص | ح | ف | م | ه | ى | ٢ | ٦ |
| C | | | | | | | | | صـ | ع | ف | مـ | ي | | | ٧ |
| D | | | | | | | | | ض | غ | ق | ن | ه | ي | ٣ | ٨ |
| E | | | | | | | | | ظ | غ | ق | ن | | ي | ٤ | ٩ |
| F | | | | | | | | | ط | خ | ك | د | و | • | | ٥ |

| KEYED CHAR. | CURRENT STATE | NEXT STATE | CHARACTERS AS DISPLAYED AND REDISPLAYED ON CRT |
|---|---|---|---|
| ج | B | F | جـ |
| م | F | M | جمـ |
| ا | M | B | جمـا |
| ل | B | LF | جمـالـ |
| ة | LF | B | جمـالة |
| م | B | F | مـ |
| و | F | B | مـو |
| س | B | SF | موسـ |
| و | SF | B | موسو |
| س | B | SF | موسوسـ |
| ة | SF | B | موسوسة |
| ع | B | F | عـ |
| ة | F | B | عة |

APPENDIX B-2

| KEYED CHAR. | CURRENT STATE | NEXT STATE | CHARACTERS AS DISPLAYED AND REDISPLAYED ON CRT |
|---|---|---|---|
| آ | B | B | آ |
| ل | B | LF | آل |
| ا | LF | B | آلا |
| م | B | F | آلام |
| ط | F | B | آلامط |

APPENDIX B-3

| KEYED CHAR. | CURRENT STATE | NEXT STATE | CHARACTERS AS DISPLAYED AND REDISPLAYED ON CRT |
|---|---|---|---|
| ع | B | F | ع |
| ب | F | M | عب |
| ع | M | M | عبع |
| ب | M | M | عبعب |
| ع | M | M | عبعبع |
| ﻻ | M | B | عبعبعﻻ |
| ﻫ | B | F | ﻫ |
| ي | F | M | ﻫي |
| ﻫ | M | M | ﻫيﻫ |
| ي | M | M | ﻫيﻫي |
| ا | M | B | ﻫيﻫيا |

APPENDIX B-4

| KEYED CHAR. | CURRENT STATE | NEXT STATE | CHARACTERS AS DISPLAYED AND REDISPLAYED ON CRT |
|---|---|---|---|
| ج | B | F | جـ |
| ـ | F | F | جـَ |
| م | F | M | جـَمـ |
| ـ | M | M | جـَمـَ |
| ا | M | B | جـَمـَا |
| ل | B | LF | جـَمـَال |
| و | LF | LF | جـَمـَالُ |
| ة | LF | B | جـَمـَالُة |
| | | | |
| ش | B | SF | شـ |
| ـ | SF | SF | شـَ |
| م | SF | M | شـَمـ |
| س | M | SM | شـَمـسـ |
| و | SM | SM | شـَمـسُ |
| ة | SM | B | شـَمـسُة |

APPENDIX B-5

| KEYED CHAR. | CURRENT STATE | NEXT STATE | CHARACTERS AS DISPLAYED AND REDISPLAYED ON CRT |
|---|---|---|---|
| ا | B | B | ا |
| لا | B | B | الا |
| س | B | B | الاس |
| ا | B | B | ا |
| ل | B | LF | ال |
| س | LF | LF | الـسـ |
| ا | LF | B | الاس |
| ا | B | B | ا |
| ل | B | LF | الـ |
| س | LF | LF | الـسـ |
| ذ | LF | B | الـسـذ |
| ي | B | F | الـسـذي |
| ظ | F | B | الـسـذي |

APPENDIX C

| | | | | | | | | | | | | | | | | | | | |
|---|---|---|---|---|---|---|---|---|---|---|---|---|---|---|---|---|---|---|---|
| | 1 | 1 | 2 | 2 | 2 | 2 | 2 | 2 | 1 | 1 | 4 | 4 | 2 | 2 | 2 | 2 | 2 | 3 | 3 |
| $S_{FND}$ = | ( | ـ | ك | ب | ت | ث | ج | ح | خ | ط | ظ | ع | غ | ف | ق | ك | م | ن | ه | ي | ) |
| $S_{BND}$ = | ( | ـ | ك | ب | ت | ث | ج | ح | خ | ط | ظ | ع | غ | ف | ق | ك | م | ن | ه | ي | ) |
| $S_{MND}$ = | ( | ـ | ك | ب | ت | ث | ج | ح | خ | ط | ظ | ع | غ | ف | ق | ك | م | ن | ه | ي | ) |
| $S_{END}$ = | ( | ـ | ك | ب | ت | ث | ج | ح | خ | ط | ظ | ع | غ | ف | ق | ك | م | ن | ه | ي | ) |
| $S_{FD}$ = | ( | ؤ | ة | د | ذ | ر | ز | و | ى | ) | | | | | | | | | | | |
| $S_{CD}$ = | ( | ؤ | ة | د | ذ | ر | ز | و | ى | ) | | | | | | | | | | | |
| $S_{FL}$ = | ( | ل | ) | | | | | | | | | | | | | | | | | | |
| $S_{BL}$ = | ( | ـل | ) | | | | | | | | | | | | | | | | | | |
| $S_{ML}$ = | ( | ـل | ) | | | | | | | | | | | | | | | | | | |
| $S_{EL}$ = | ( | ل | ) | | | | | | | | | | | | | | | | | | |
| $S_{FA}$ = | ( | ا | أ | إ | آ | ) | | | | | | | | | | | | | | | |
| $S_{CA}$ = | ( | ـا | ـأ | ـإ | ـآ | ) | | | | | | | | | | | | | | | |
| $S_{FLA}$ = | ( | لا | لأ | لإ | لآ | ) | | | | | | | | | | | | | | | |
| $S_{CLA}$ = | ( | لا | لأ | لإ | لآ | ) | | | | | | | | | | | | | | | |
| $S_{BS}$ = | ( | ضـ | صـ | شـ | سـ | ) | | | | | | | | | | | | | | | |
| $S_{MS}$ = | ( | ضـ | صـ | شـ | سـ | ) | | | | | | | | | | | | | | | |
| $S_{FS}$ = | ( | ضر | صر | شر | سر | ) | | | | | | | | | | | | | | | |
| $S_{ES}$ = | ( | ضر | صر | شر | سر | ) | | | | | | | | | | | | | | | |
| $S_{FV}$ = | ( | ّ | ) | | | | | | | | | | | | | | | | | | |
| $S_{CV}$ = | ( | ـّ | ) | | | | | | | | | | | | | | | | | | |
| $S_{TAIL}$ = | ( | ـ | ) | | | | | | | | | | | | | | | | | | |

$S_{NA}$ = (A-Z, 0-9, .-9, spec. character, s)

APPENDIX D 4 shapes/character $S^5_{FND}$ = ( ع غ )

$S^5_{BND}$ = ( ـع ـغ )

$S^5_{MND}$ = ( ـعـ ـغـ )

$S^5_{END}$ = ( ـع ـغ )

3 shapes/character $S^4_{FND}$ = ( ه )

$S^4_{BND}$ = ( ـه )

$S^4_{MND}$ = ( ـهـ )

3 shapes/character $S^3_{FND}$ = ( ي )

$S^3_{BND}$ = ( ـيـ )

$S^3_{END}$ = ( ـي )

2 shapes/character $S^2_{FND}$ = ( ب ت ث ج ح خ ف ق ك م ن ) = $S_{END}$ $S^2_{BND}$ = ( ـبـ ـتـ ـثـ ـجـ ـحـ ـخـ ـفـ ـقـ ـكـ ـمـ ـنـ ) = $S_{MND}$ 1 shape/character $S^1_{FND}$ = ( ـئـ ـطـ ـظـ ـ ) = $S_{BND}$ = $S_{MND}$ = $S_{END}$

---

$S_{FD}$ = ( ة ؤ د ذ ر ز و ) = $S_{CD}$ $S_{FD}$ = ( ى )

$S_{CD}$ = ( ـى )

$S_{FA}$ = ( آ أ ؤ ا )

$S_{CA}$ = ( ـآ ـأ ـؤ ـا )

$S_{FLA}$ = ( لآ لأ لؤ لا )

$S_{CLA}$ = ( ـلآ ـلأ ـلؤ ـلا )

---

$S_{BS}$ = ( ـسـ ـشـ ـصـ ـضـ ) = $S_{MS}$ $S_{FS}$ = ( س ش ص ض ) = $S_{ES}$ $S_{FV}$ = ( ـّ )

$S_{CV}$ = ( ّ )

---

$S_{TAIL}$ = ( ـل )

$S_{NA}$ = ( A-Z, 0-9, ٠-٩, spec. char.,s )

$S_{FL}$ = ( ل ) = $S_{EL}$ $S_{BL}$ = ( ـل ) = $S_{ML}$

The embodiment of the invention in which an exclusive property or privilege is claimed are defined as follows:

1. The method of selecting appropriate shapes of characters, for displaying and/or printing Arabic script, comprising the steps of:

(a) classifying the characters in an Arabic character set into different, predetermined sets in accordance with predefined character functions, said functions comprising dividing, non-dividing and vowel functions, each predetermined set consisting of characters capable of being written in one or more positions within an Arabic word or phrase;

(b) subdividing each predetermined set into specific groups of character shapes, each group consisting of character shapes that are limited, respectively, to specific, single, character positions within an Arabic word or phrase;

(c) selecting the predetermined set of any input character through a code generated by keying such character;

(d) logically determining the group, and therefore the character shape of any such selected character, appropriate to the word or phase positions for which the character was selected, wherein, said logical determination of character shapes is effected under production rules establishing which character shapes and therefore which groups of character shapes, must be entered at any given location in a word or phrase; and (e) providing a plurality of logic states to respectively represent different positions that selected characters may be required to occupy in any given work or phrase.

2. The method of selecting appropriate character shapes as defined in claim 1 wherein said plurality of logic states include two states relating to compound shapes of characters.

3. The method of selecting appropriate character shapes as defined in claim 1 wherein said plurality of states include two states relating to special end-of-word and stand-alone shapes of characters.

4. The method of selecting appropriate shapes of characters, for displaying and/or printing Arabic script, comprising the steps of:

(a) classifying the characters in an Arabic character set into different, predetermined sets in accordance with predefined character functions, said functions comprising dividing, non-dividing and vowel functions, each predetermined set consisting of characters capable of being written in one or more positions within an Arabic word or phase;

(b) sub-dividing each predetermined set into specific groups of character shapes, each group consisting of character shapes that are limited, rspectively, to specific, single, character positions within an Arabic word or phrase;

(c) selecting the predetermined set of any input character through a code generated by keying such character;

(d) logically determining the group, and therefore the character shape of any such selected character, appropriate to the word or phrase positions for which the character was selected, wherein logical determination of character shapes is effected through a plurality of logic states operating under respective character production rules to establish which character shapes, and therefore which groups of character shapes, must be entered at any given location in a word or phrase, said plurality of logic states respectively relating to dividing, non-dividing, vowel, compound, special end-of-word and stand-alone shapes of characters.

5. The method of selecting appropriate character shapes as defined in claims 4 where, in the event of memory loss, an initialization state is automatically invoked, preceding characters are checked and the last logic state prior to memory loss is re-instated.

6. The method of selecting appropriate shapes of characters, for displaying and/or printing Arabic script, comprising the steps of:

(a) classifying the charactes in an Arabic character set into different, predetermined sets in accordance with predefined character functions, said functions comprising dividing, non-dividing and vowel functions, each predetermined set consisting of characters capable of being written in one or more positions within an Arabic word or phase;

(b) subdividing each predetermined set into specific groups of character shapes, each group consisting of character shapes that are limited, respectively, to specific, single, character positions within an Arabic word or phrase;

(c) selecting the predetermined set of any input character through a code generated by keying such character;

(d) logically determining the group, and therefore the character shape of any such selected character, appropriate to the word or phrase positions for which the character was selected, and (e) selectively initiating a logic state for the production of initials and acronyms by limiting shape selection to the stand-alone shape.

7. A machine method of automatically generating cursive script for a context sensitive language wherein the various characters may each have a number of different shapes depending upon particular character location within a word or part of a word, comprising the steps of:

(a) generating a class code for each successive selected character, each class code being representative of the connectability or non-connectability of its associated character to a succeeding character;

(b) in dependence upon the class codes generated for a current selected character and its immediately preceding class code, generating an output code identifying a predicted shape for the current selected character, and (c) upon generating a code representing a word delimiter, where necessary to comply with the context sensitivity of the language, re-shaping the last character of the word.

8. A machine method as defined in claim 7, wherein each generated class code constitutes an input to an invoked state of a plurality of states in a finite-state machine, each said input effectively producing:

(a) an output code identifying a predicted character shape for a current selected character, and, (b) a decision to retain or change the invoked state for processing the next successive character class code.

9. A machine method as defined in claim 8 wherein said plurality of states includes three states nominally identified as a beginning-of-word state, a medial state, and a free-standing state, each state being comprised of a sub-routine responsive to the input of a character class code to direct an appropriate output character class code and to determine the state to be used in processing the next successive character class code, such that the plurality of states effectively memorizes current position in a word being processed.

* * * * *